United States Patent [19]

Ahrens

[11] Patent Number: 4,691,833

[45] Date of Patent: Sep. 8, 1987

[54] CAP ALIGNMENT STRUCTURE

[75] Inventor: Warren S. Ahrens, Milford, Conn.

[73] Assignee: The Bridgeport Metal Goods Mfg. Co., Bridgeport, Conn.

[21] Appl. No.: 701,976

[22] Filed: Feb. 15, 1985

[51] Int. Cl.[4] ..... B65D 41/04

[52] U.S. Cl. ..... 215/227; 215/330; 215/331

[58] Field of Search ..... 215/227, 330, 331

[56] References Cited

U.S. PATENT DOCUMENTS

| | | | |
|---|---|---|---|
| 2,265,015 | 12/1941 | Watson | 215/331 X |
| 3,004,681 | 10/1961 | Jinkens et al. | 215/227 |
| 3,581,926 | 6/1971 | Roder | 215/330 |
| 4,273,248 | 6/1981 | Lehman | 215/331 |
| 4,289,248 | 9/1981 | Lynn | 215/331 X |
| 4,310,101 | 1/1982 | Sekine | 215/330 |
| 4,456,137 | 6/1984 | Lyman | 215/331 X |
| 4,519,518 | 5/1985 | Wiles et al. | 215/331 |

FOREIGN PATENT DOCUMENTS

| | | |
|---|---|---|
| 225923 | 10/1924 | United Kingdom . |
| 1171246 | 11/1969 | United Kingdom . |
| 1283838 | 8/1972 | United Kingdom . |
| 2163732 | 3/1986 | United Kingdom . |

*Primary Examiner*—Donald F. Norton
*Attorney, Agent, or Firm*—Armand Cifelli

[57] ABSTRACT

A container and cap assembly for holding cosmetic material and the like has a container molded from a plastic material with a generally noncircular configuration defined by a main body member with an upwardly extending neck member thereon. The neck member is provided with a pair of integrally formed exterior double lead threads emanating from an enlarged base portion of the neck member and forming abutment end walls therewith. The cap assembly has an outer shroud member with a noncircular configuration identical to the noncircular configuration of main body member mounted on a head member having integrally formed interior double lead threads with leading abutment end surfaces thereon. The double lead threads of the neck member and head member are designed for mating engagement whereby the abutment end walls and the abutment end surfaces thereof engage when the cap assembly is in its closed or sealing condition on the container to circumferentially align the parts. The mating threads are provided with pitch down regions while the container and cap assembly are provided with abutting projections to restrain reverse rotation or removal of the cap assembly from the container.

23 Claims, 8 Drawing Figures

CAP ALIGNMENT STRUCTURE

BACKGROUND OF THE INVENTION

The present invention relates generally to product containers and the like, and more particularly to noncircular product containers having removable noncircular caps.

Product containers for a wide variety of cosmetic materials in a variety of forms such as liquid, gel or compressed powder have been utilized for a number of years with removable caps. Generally, the caps have an applicator implement joined thereto for removing the product stored within the container and applying it to the body of the user. To provide a decorative and attractive container and a cap therefor, these items are often manufactured with noncircular configurations; i.e. square, oval triangular, etc. One of the major drawbacks of such configurations has been that the circumference of the noncircular container must be accurately aligned with the circumference of its associated noncircular cap when the cap is fully tightened or seated on the container. If the alignment is not accurately achieved, the desirable aesthetic features of the container and the cap are destroyed.

It is an object of the present invention to provide a novel container and cap assembly having means to accurately align the noncircular configurations thereof.

It is also an object to provide such a container and cap assembly which inhibits or restrains removal of the cap assembly when it is in a fully tightened or sealed relationship with the container.

A further object is to provide such a container and cap assembly which may be readily and economically fabricated and will enjoy a long life in operation.

SUMMARY OF THE INVENTION

It has now been found that the foregoing and related objects can be readily attained in a container having a center plane and a main body member with a noncircular circumference and with an upwardly extending, centrally located neck member. The neck member has a pair of integrally formed exterior double lead threads thereon emanating from a base portion and cooperating therewith to define a pair of diametrically opposed abutment end walls. A cap assembly for the container has a center plane, a noncircular circumference, and a pair of integrally formed interior double feed threads adapted for mating engagement with the double lead threads of the neck member. The double lead threads of the cap assembly have diametrically opposed leading end walls defining abutment surfaces, whereby the cap assembly is adapted to be screwed on to the container until the abutment surfaces of the cap assembly engage the abutment end walls of the neck member so that the center planes of the container and the cap assembly achieve coplanarity.

Desirably, the noncircular circumferences of the container and the cap assembly are identical and circumferentially align when the abutment end walls and the abutment surfaces are in engagement. The abutment end walls of the neck member lie on the center plane of the container and the abutment surfaces of the cap assembly lie on the center plane thereof.

Ideally, the cap assembly includes a shroud member and a head member with at least a portion of the head member captured within a recess formed in the shroud member. The recess includes a key and the head member includes a mating keyway for aligning the head member within the shroud member. Additionally, the head member has a flat top wall, a downwardly depending sidewall with the double lead threads of the cap assembly integrally formed on the interior thereof, and a downwardly depending, centrally located applicator rod adapted to receive a cosmetic applicator. Furthermore, the neck member of the container has an upper lip portion, which may mount a seal, cooperatively dimensioned for sealing engagement with the flat top wall of the head member when the abutment end walls and the abutment surfaces are in engagement.

Conveniently, the main body member of the container includes a shoulder having diametrically opposed projections thereon and the cap assembly has diametrically opposed projections thereon. The projections of the container and the cap assembly cooperatively dimensioned to engage and tend to hold the container the cap assembly in assembly when the abutment end walls and the abutment surfaces are in engagement. The double lead threads of the container and the cap assembly include a pinch down region tending to hold the container and cap assembly in the fully assembled position when the abutment end walls and the abutment surfaces are in engagement. The projections and pinch down regions may be employed individually or in combination for that purpose.

The invention will be fully understood when reference is made to the following description of the preferred embodiment and the claims, taken in conjunction with the accompanying drawings.

DETAILED DESCRIPTION OF THE PREFERRED EMBODIMENT

Figure 1:
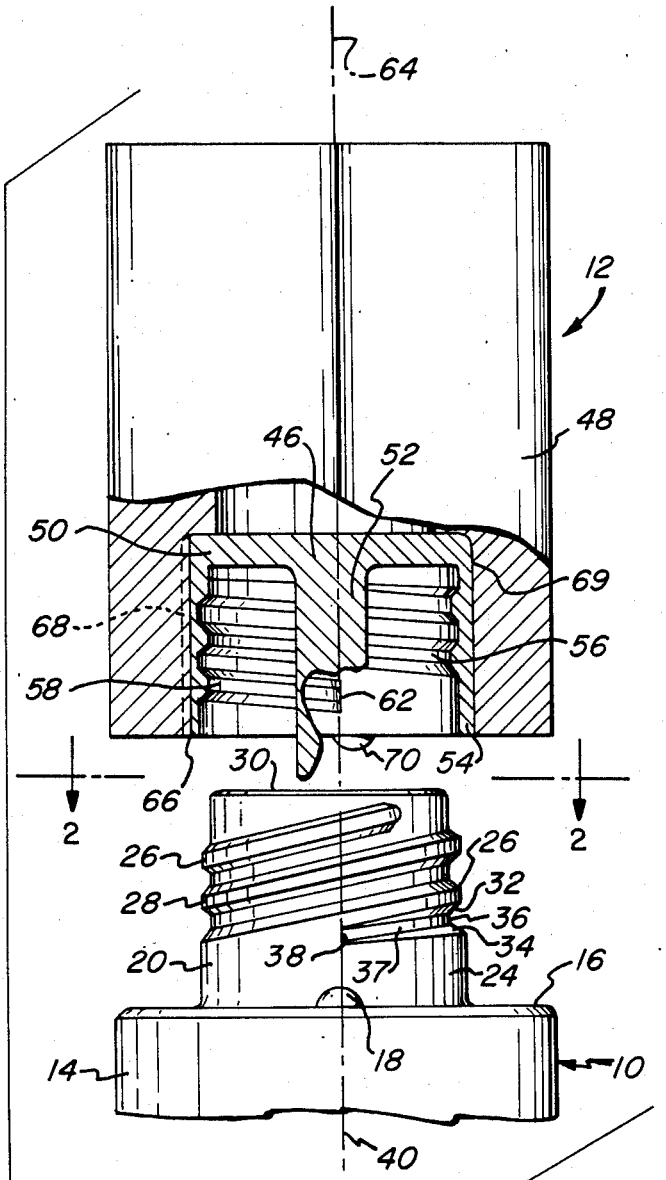
FIG. 1 is an exploded side elevational view of a cap assembly and fragmentary portion of a cosmetic container embodying the present invention, the cap assembly being broken away to show internal structure.

Referring first to FIG. 1, therein illustrated is an integrally molded plastic container generally designated by the numeral 10 and a cap assembly therefor generally designated by the numeral 12. The container 10 is in the form of a bottle for holding a reservoir of cosmetic material such as mascara which is applied to the body of the user by means of an appropriate applicator. While a cosmetic bottle is shown for purposes of this description, the invention is equally applicable for containers for other products.

Figure 2:
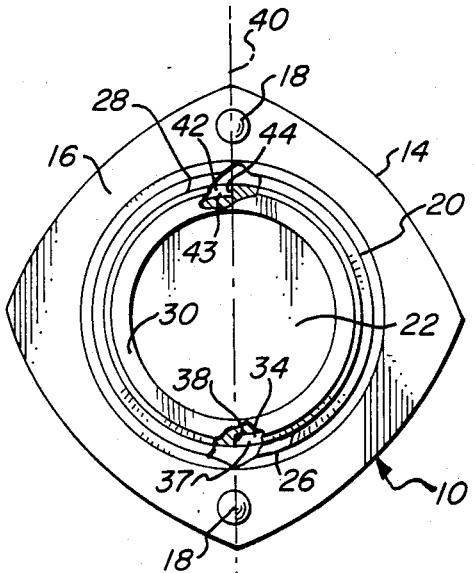
FIG. 2 is a top elevational view of the cosmetic container taken along the 2—2 line of FIG. 1.

As best seen in FIGS. 1 and 2, the container 10 has a main body member 14 having a generally noncircular circumference and being of a hollow configuration for holding a reservoir of product material (not shown). The container can be formed by conventional plastic blow molding techniques from any suitable plastic material such as polystyrene, polyethylene or polypropylene but preferably polyvinylchloride. At the upper end of the container 10 is a top wall or shoulder 16 having a pair of diametrically opposed semispherical projections 18 extending upwardly therefrom. Centered on and extending upwardly from the shoulder 16 is a neck member 20 defining an orifice 22 which acts as both an ingress and egress to the interior of the hollow main body member 14.

The neck member 20 has an enlarged diameter base portion 24, a pair of integrally formed threads 26 and 28, and a reduced diameter lip portion 30. The pair of threads 26 and 28 are known in the art as double lead threads in that their upper or leading ends begin or start from diametrically opposite sides of the neck member 20 and are interspaced as they spiral thereabout. Each of the threads 26 and 28 emanate at their lower ends from the enlarged base portion 24 of the neck member 20. As seen in FIG. 1, the thread 26 has a sloping side wall 32 joined to a sloping wall 34 of the base portion 24 by root wall 36. The walls 32 and 34 terminate at their lower ends at an abutment end wall 38 which lies on an imaginary center plane 40 of the container 10. The walls 32 and 34 taper toward one another as they move downwardly toward the abutment end wall 38 to form a pinch down space or region 37 for purposes to be explained hereinafter.

As best seen in FIG. 2, the thread 28 is identical to thread 26 but starts diametrically opposite therefrom. Thread 28 cooperates with the sloping wall 42 of the base portion 24 to form a pinch down region 43 and an abutment end wall 44 also located on the center plane 40 of the container 10.

The cap assembly 12 is comprised of a head member 46 and a decorative shroud or cap member 48. The head member 46 can be formed of various polymer plastics suitable for plastic injection molding; a preferred material is sold under the trademark "Delrin". The head member 46 has a flat top wall 50 with a downwardly depending applicator rod 52. The applicator rod 52 includes an opening 53 therein adapted to receive an applicator (not shown), which may be a radially or longitudinally aligned bristle brush or a felt or cellular foam implement, to which the cosmetic material or product adheres when the cap assembly 12 is joined to the container 10.

Figure 3:
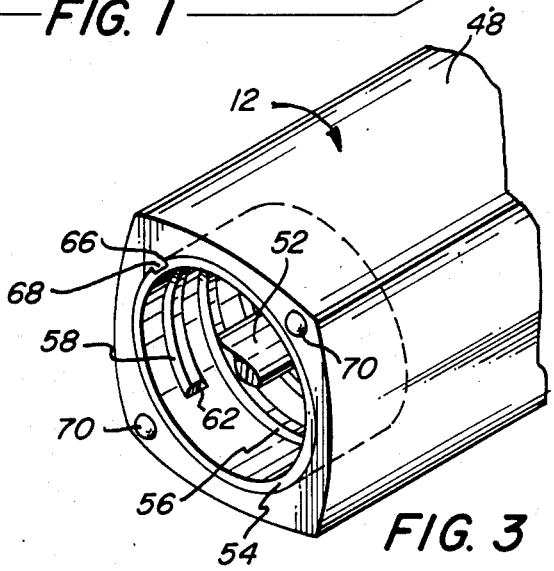
FIG. 3 is a perspective view of the cap assembly with the applicator rod broken away for clarity of illustration.
Figure 4:
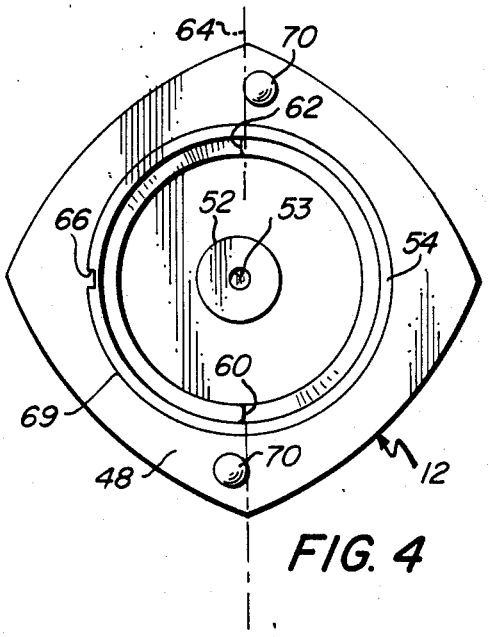
FIG. 4 is a bottom elevational view of the cap assembly.

Surrounding the applicator rod 52 and depending downwardly from the top wall 50 is a cylindrically shaped skirt or sidewall 54. The side wall 54 has a pair of integrally formed interior neck engaging double lead threads 56 and 58 dimensioned for mating engagement with the double lead threads 26 and 28 of the neck member 20 of the container 10. In a manner similar to the double lead threads 26 and 28 of the cap member 20, the double lead threads 56 and 58 begin or start from diametrically opposite interior sides of the sidewall 54 and are interspaced as they spiral therein. As best seen in FIGS. 3 and 4, the lead ends of the threads 56 and 58 are squared off to form abutment surfaces 60 and 62 which are coplanar with an imaginary center plane 64 of the cap assembly 12.

Located in the exterior of the skirt 54 is a longitudinally extending keyway 66 for receiving a key 68 of the cap member 48. The keyway 66 and the key 68 provide proper alignment of the head member 46 and the cap member 48 when the head member 46 is press fit or otherwise secured within recess 69 of the cap member 48. The cap member 48 is hollow with a noncircular circumference identical to the noncircular circumference of the main body member 14 and can be formed from a suitable polymer plastic or decorative metal material.

Depending downwardly from and integrally formed with the cap member 48 are a pair of semispherical projections 70 offset slightly from the center plane 64 of the cap assembly 12. The projections 70 are cooperatively dimensioned and positioned on the cap assembly for interaction with the projections 18 of the container 10 in a manner and for purposes to be explained further hereinafter.

Figure 6:
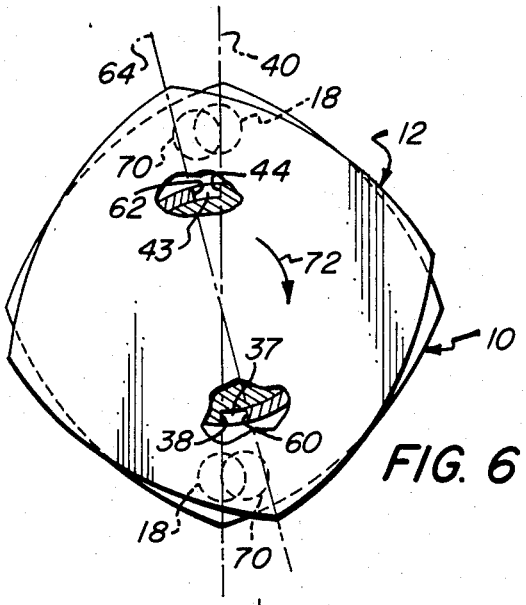
FIG. 6 is a top elevational view of the cap assembly and cosmetic container of FIG. 5 with portions being broken away to show internal structure.
Figure 5:
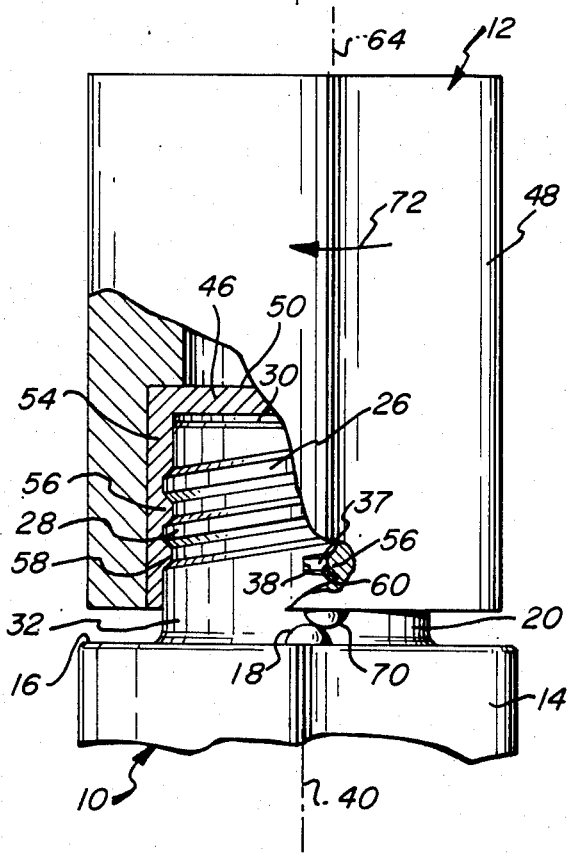
FIG. 5 is a side elevational view of the cap assembly as it is being screwed onto the neck member of the cosmetic container, the cap assembly being broken away to show internal structure.

The operation of the container 10 and the cap assembly 12 will be more fully understood when considering FIGS. 5 through 8. The mating threads 26, 28, 56 and 58 permit the cap assembly 12 to be tightened on the container 10 as the cap assembly 12 is turned in the clockwise direction looking down on the container 10. As seen in FIGS. 5 and 6, the cap assembly 12 is being turned in the clockwise direction indicated by arrow 72 to tighten it onto the container 10. As the cap assembly 12 approaches its closed or sealed condition on the container 10, the projections 18 and 70 engage each other and flex or deflect to a slight degree during the tightening process to allow projections 70 to pass by projections 18. Concurrently, the threads 56 and 58 are travelling in the gradually decreasing pinch down regions 37 and 43 toward the diametrically opposed abutment end walls 38 and 44.

Figure 8:
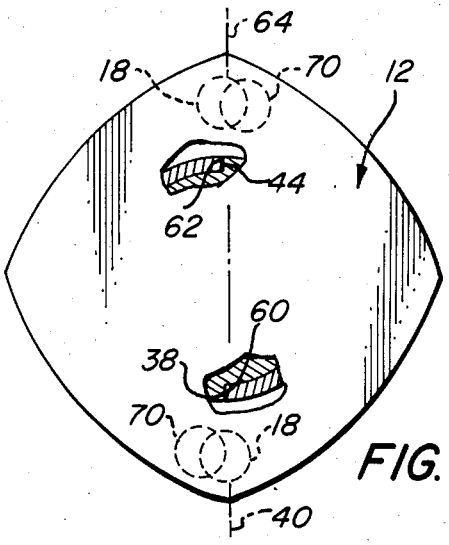
FIG. 8 is a top elevational view of the cap assembly and cosmetic container of FIG. 7 with portions broken away to show internal structure.
Figure 7:
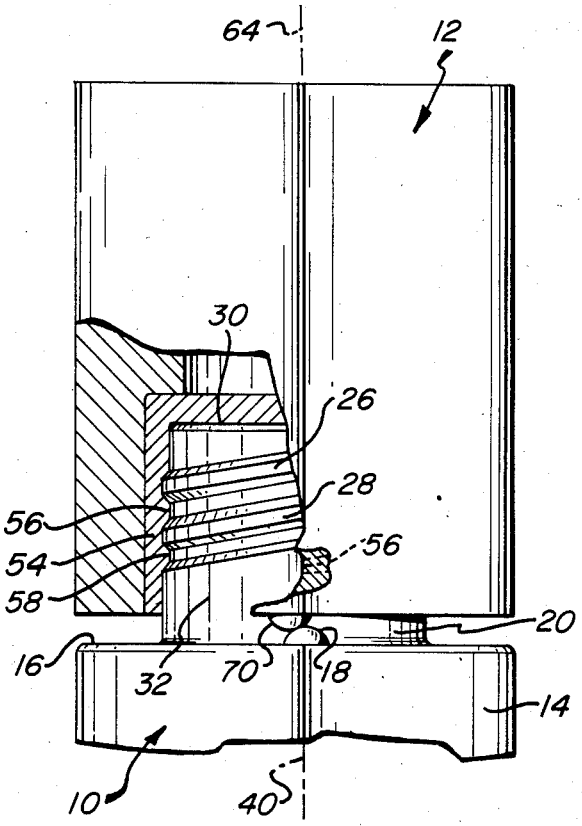
FIG. 7 is a side elevational view similar to FIG. 5 and illustrating the cap assembly in sealing position on the neck member of the cosmetic container.

As seen in FIGS. 7 and 8, the bottom wall of the cap assembly 12 and the shoulder 16 of the container 10 are in a closely spaced relationship when the top wall 50 and the lip portion 30 are in their closed or sealing condition. The abutment end walls 38 and 44 provide a positive stop for the abutment surfaces 60 and 62 of the double lead threads 56 and 58 at which point the center planes 40 and 64 of the container 10 and the cap assembly 12, respectively, achieve coplanarity and the container 10 and the cap assembly 12 are circumferentially aligned. The projections 18 and 70 cooperate to restrain reverse rotation or removal of the cap assembly 12 from the container 10. Additionally, the double lead threads 56 and 58 are frictionally engaged by the pinch down regions 37 and 43 of the neck member to further inhibit removal of the cap assembly 12 from the container 10. The pinch down regions 32 and 43 may be used alone or in combination with the projections 18 and 70 to restrain the cap from rotation.

Although not shown for purposes of clarity, it will be readily understood by those skilled in the art that a resilient washer-like upper flange of a cosmetics wiper assembly may be positioned on lip 30 to act as a seal, with lip 30 being dimensioned accordingly. Alternatively, a washer seal may be mounted adjacent top wall 50.

Thus, it can be seen from the foregoing specification and the attached drawings that the present invention provides an effective means for providing circumferential alignment of and positive engagement between the cap assembly and the container.

The preferred embodiment described above admirably achieves the objects of the invention; however, it will be appreciated that departures can be made by those skilled in the art without departing from the spirit and scope of the invention which is limited only by the following claims.

Having thus described the invention, I claim:

1. A container and a cap assembly therefor comprising:

a. a container having a main body member with a noncircular circumference and an imaginary center plane therethrough and a neck member with a pair of integrally formed exterior double lead threads emanating from a base portion thereof, said double lead threads and said base portion cooperating to define a pair of diametrically opposed abutment end walls, said main body member of said container includes a shoulder having diametrically opposed projections thereon; and b. a cap assembly having a noncircular circumference and an imaginary center plane therethrough, and a pair of integrally formed interior double lead threads adapted for mating engagement with said double lead threads of said neck member, said double lead threads of said cap assembly having diametrically opposed leading end walls defining abutment surfaces, said cap assembly also having diametrically opposed projections thereon, whereby said cap assembly is adapted to be screwed on to the neck of said container until said abutment surfaces of said cap assembly engage said abutment end walls of said neck member so that said center planes of said container and said cap assembly achieve coplanarity, said projections of said container and said cap assembly cooperatively dimensioned to produce a force tending to hold said container and cap assembly in assembly when said abutment end walls and said abutment surfaces are in engagement.

2. The container and cap assembly in accordance with claim 1 wherein said noncircular circumferences of said container and said cap assembly are identical and circumferentially align when said abutment end walls and said abutment surfaces are in engagement.

3. The container and cap assembly in accordance with claim 1 wherein said abutment end walls of said neck member lie on said center plane of said container and said abutment surfaces of said cap assembly lie on said center plane thereof.

4. The container and cap assembly in accordance with claim 1 wherein said cap assembly includes a shroud member and a head member.

5. The container and cap assembly in accordance with claim 1 wherein at least a portion of said head member is captured within a recess formed in said shroud member.

6. The container and cap assembly in accordance with claim 5 wherein said recess includes a key and said head member includes a mating keyway for aligning said head member within said shroud member.

7. The container and cap assembly in accordance with claim 4 wherein said head member includes an applicator rod adapted to receive a cosmetic applicator.

8. The container and cap assembly in accordance with claim 4 wherein said head member has a flat top wall and a downwardly depending side wall.

9. The container and cap assembly in accordance with claim 8 wherein said double lead threads of said cap assembly are integrally formed on the interior of said downwardly depending sidewall.

10. The container and cap assembly in accordance with claim 8 wherein said top wall has downwardly depending applicator rod adapted to receive a cosmetic applicator.

11. The container and cap assembly in accordance with claim 8 wherein said neck member of said container has an upper lip portion cooperatively dimensioned for sealing engagement with said flat top wall of said head member when said abutment end walls and said abutment surfaces are in engagement.

12. The container and cap assembly in accordance with claim 1 wherein said double lead threads of said container and said cap assembly include a pinch down means tending to hold said container and cap assembly in assembly when said abutment end walls and said abutment surfaces are in engagement.

13. A container and a cap assembly therefor comprising:

a. a container having a main body member with a noncircular circumference and an imaginary center plane therethrough and a neck member with a pair of integrally formed exterior double lead threads emanating from a base portion thereof, said double lead threads and said base portion cooperating to define a pair of diametrically opposed abutment end walls; and b. a cap assembly having a noncircular circumference and an imaginary center plane therethrough, and a pair of integrally formed interior double lead threads adapted for mating engagement with said double lead threads of said neck member, said double lead threads of said cap assembly having diametrically opposed leading end walls defining abutment surfaces, whereby said cap assembly is adapted to be screwed on to the neck of said container until said abutment surfaces of said cap assembly engage said abutment end walls of said neck member so that said center planes of said container and said cap assembly achieve coplanarity, said double lead threads of said container and said cap assembly include a pinch down means tending to hold said container and cap assembly in assembly when said abutment end walls and said abutment surfaces are in engagement.

14. The container and cap assembly in accordance with claim 13 wherein said noncircular circumferences of said container and said cap assembly are identical and circumferentially align when said abutment end walls and said abutment surfaces are in engagement.

15. The container and cap assembly in accordance with claim 13 wherein said abutment end walls of said neck member lie on said center plane of said container and said abutment surfaces of said cap assembly lie on said center plane thereof.

16. The container and cap assembly in accordance with claim 13 wherein said cap assembly includes a shroud member and a head member.

17. The container and cap assembly in accordance with claim 16 wherein at least a portion of said head member is captured within a recess formed in said shroud member.

18. The container and cap assembly in accordance with claim 16 wherein said recess includes a key and said head member includes a mating keyway for aligning said head member within said shroud member.

19. The container and cap assembly in accordance with claim 16 wherein said head member includes an applicator rod adapted to receive a cosmetic applicator.

20. The container and cap assembly in accordance with claim 16 wherein said head member has a flat top wall and a downwardly depending side wall.

21. The container and cap assembly in accordance with claim 20 wherein said double lead threads of said cap assembly are integrally formed on the interior of said downwardly depending sidewall.

22. The container and cap assembly in accordance with claim 20 wherein said top wall has downwardly depending applicator rod adapted to receive a cosmetic applicator.

23. The container and cap assembly in accordance with claim 20 wherein said neck member of said container has an upper lip portion cooperatively dimensioned for sealing engagement with said flat top wall of said head member when said abutment end walls and said abutment surfaces are in engagement.

* * * * *

UNITED STATES PATENT AND TRADEMARK OFFICE

CERTIFICATE OF CORRECTION

PATENT NO. : 4,691,833

DATED : September 8, 1987

INVENTOR(S) : Warren S. Ahrens

It is certified that error appears in the above-identified patent and that said Letters Patent is hereby corrected as shown below:

In Claim 5, column 5, line 56, change "1" to -- 4 --.

Signed and Sealed this

Twenty-ninth Day of November, 1988

*Attest:*

*Attesting Officer*

DONALD J. QUIGG

*Commissioner of Patents and Trademarks*